US008607857B2

(12) United States Patent
Lynde et al.

(10) Patent No.: US 8,607,857 B2
(45) Date of Patent: Dec. 17, 2013

(54) VACUUM DEBRIS REMOVAL WITH ARTICULATED PICKUP AND VISUAL CAPABILITY

(75) Inventors: Gerald D. Lynde, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 433 days.

(21) Appl. No.: 12/971,405

(22) Filed: Dec. 17, 2010

(65) Prior Publication Data

US 2012/0151707 A1 Jun. 21, 2012

(51) Int. Cl.
*E21B 31/08* (2006.01)

(52) U.S. Cl.
USPC ..... 166/99; 175/77; 175/78

(58) Field of Classification Search
USPC ..... 166/99, 100, 249; 175/77–78, 249
See application file for complete search history.

(56) References Cited

U.S. PATENT DOCUMENTS

| | | | | |
|---|---|---|---|---|
| 2,389,512 | A * | 11/1945 | Humason | 166/100 |
| 4,991,006 | A | 2/1991 | Wood | |
| 5,197,783 | A | 3/1993 | Theimer et al. | |
| 5,275,038 | A | 1/1994 | Sizer et al. | |
| 5,373,906 | A | 12/1994 | Braddick | |
| 5,689,734 | A | 11/1997 | Bauer et al. | |
| 6,176,311 | B1 | 1/2001 | Ryan | |
| 6,250,387 | B1 | 6/2001 | Carmichael et al. | |
| 6,276,452 | B1 | 8/2001 | Davis et al. | |
| 6,325,305 | B1 | 12/2001 | Kuhlman et al. | |
| 6,390,105 | B1 | 5/2002 | Ramsey | |
| 6,607,031 | B2 | 8/2003 | Lynde et al. | |
| 7,478,687 | B2 | 1/2009 | Lynde et al. | |
| 2002/0162655 | A1 | 11/2002 | Lynde et al. | |
| 2010/0243258 | A1 | 9/2010 | Fishbeck et al. | |
| 2010/0288492 | A1 | 11/2010 | Blackman et al. | |

* cited by examiner

*Primary Examiner* — Giovanna Wright
(74) *Attorney, Agent, or Firm* — Steve Rosenblatt

(57) ABSTRACT

A debris removal tool has a lower end pickup hose into which debris laden fluid is pulled when there is circulation through the debris removal tool from the surface. An anchor near the open end of the hose stabilizes the lower end near a recess or groove from which debris is to be removed. Once the anchor is set the hose can be extended or retracted as well as rotated on its axis to pick up debris. A camera can be located in or near the hose opening to be able to see where the debris is located and for confirmation that the debris is being removed and that the debris has fully been removed.

22 Claims, 1 Drawing Sheet

VACUUM DEBRIS REMOVAL WITH ARTICULATED PICKUP AND VISUAL CAPABILITY

FIELD OF THE INVENTION

The field of the invention is the use of a debris removal tool with an articulated pickup coupled with a camera to allow a visual indication of the debris being sucked into the pickup hose.

FIELD OF THE INVENTION

Debris in a borehole has many sources. Milling up equipment creates a large quantity of debris as does removal of scale from a tubular string. Various tools have been developed to capture such debris within a tool body or an annular passage surrounding the body. Motive force for capturing the debris comes from pumps at a well surface. In one design the pumped fluids are the motive force for an eductor that pulls debris laden fluid into the lower end of a housing and through the mechanism of slowing the velocity in the housing allows some debris to settle in a retention volume and smaller debris to hit an internal screen as the remaining fluid gets sucked into the eductor. This tool type is illustrated in U.S. Pat. No. 6,276,452. Other similar tools are illustrated in U.S. Pat. Nos. 7,478,687; 6,176,311; 6,250,387 and US Publication 2002/0162655.

While such tools create the fluid movement to capture debris moving in the main bore, the ability to pick up debris in crevices, recess and side pockets is more problematic. These tools can create some vacuum at their lower end to induce debris to flow into the tool from a main wellbore but the orientation and level of vacuum generated at the tool lower end is seldom enough to induce debris out of recesses such as those in an open blowout preventer. Some operators pull the blowout preventer stack after a milling job to clean or confirm that the recesses in the preventer are not cluttered with debris to the point that the preventer will not close when required to prevent a blowout.

Some cleaning approaches involve pressurized fluid through a nozzle impacting the debris in the hope of dislodging it and later capturing it as illustrated in U.S. Pat. No. 6,390,105 or U.S. Pat. No. 6,325,305. There are several issues with this technique. One is that the fluid blast can actually impact the debris in the recess rather than dislodging it. Another issue if there is to be a separate trip to collect debris after jetting it loose is that the loosened debris can settle back into the crevice in between the trips. Multiple trips are also time consuming and therefore expensive. Some operators still pull the blowout preventer after such procedures as a milling operation to be sure that the recess spaces in the blowout preventer are clear of debris. This is a very expensive procedure in subsea applications.

Another concern is the ability to see from the surface that debris is being removed from the recess or pocket in question. Cameras that can be articulated to get close to otherwise inaccessible locations have been used as shown in U.S. Pat. No. 5,689,734 (heat exchanger or turbine blade inspection) and U.S. Pat. No. 4,991,006 (underground utility pipelines). Some applications in downhole use incorporate a fiber optic cable with auxiliary lines to keep the lens clear, as shown in U.S. Pat. No. 5,275,038. These are single purpose tools for inspection and other tools have to be run later to accomplish a repair if a problem section is spotted.

The present invention employs a debris removal tool with an articulated inlet that allows axial displacement of a pickup hose as well as extension and retraction and rotation about a longitudinal axis. The pickup hose assembly can be anchored near the desired location and extension and retraction can occur with raising or lowering the debris removal tool. A camera can be mounted in or near the pickup hose to assist in placing the end of the hose and for visual confirmation that the debris has been sucked out. Those skilled in the art will better appreciate the various aspects of the invention after a review of the detailed description of the preferred embodiment and the associated drawings while recognizing that the full scope of the invention can be found in the appended claims.

SUMMARY OF THE INVENTION

A debris removal tool has a lower end pickup hose into which debris laden fluid is pulled when there is circulation through the debris removal tool from the surface. An anchor near the open end of the hose stabilizes the lower end near a recess or groove from which debris is to be removed. Once the anchor is set the hose can be extended or retracted as well as rotated on its axis to pick up debris. A camera can be located in or near the hose opening to be able to see where the debris is located and for confirmation that the debris is being removed and that the debris has fully been removed.

DETAILED DESCRIPTION OF THE PREFERRED EMBODIMENT

Figure 1:
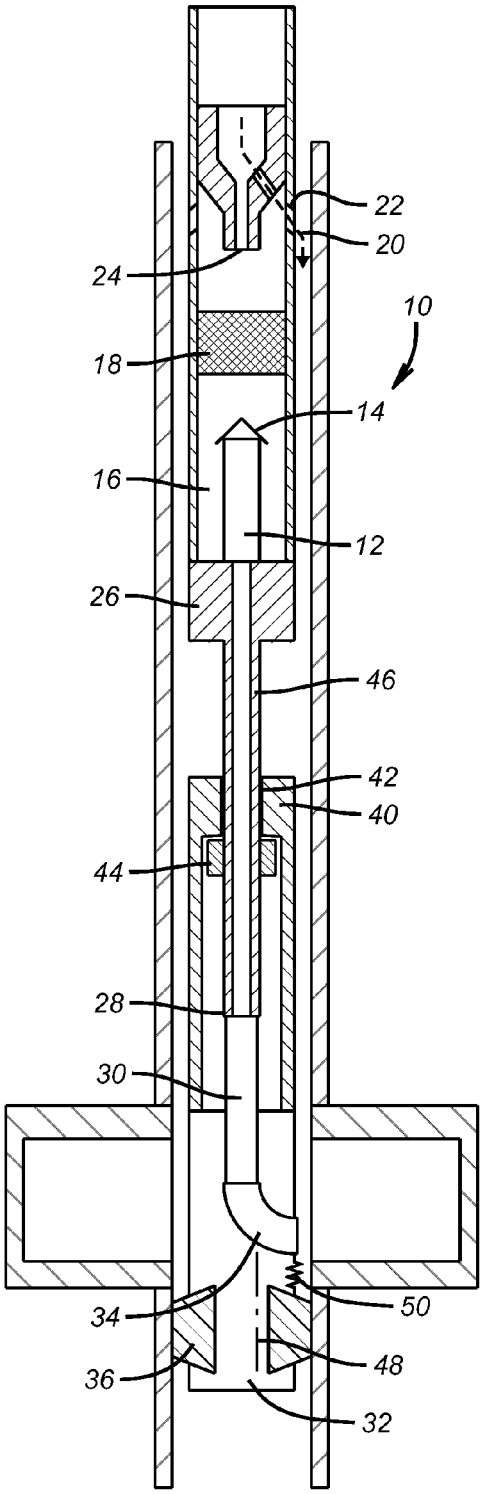
FIG. 1 is a schematic view of the apparatus of the present invention in the run in position.

FIG. 1 illustrates a debris removal tool of a known design such as described in U.S. Pat. No. 6,276,452 that has lower end modification for use as part of the present invention. The debris removal device 10 has a debris laden fluid stream inlet 12 where the fluid and debris are drawn in and hit the deflector cap 14. The heavier debris settles as the velocity slows coming out of the inlet and out from under the deflector 14. The heavier debris settles in chamber 16 as the flowing stream with the lighter debris hits screen 18. Flow from the surface represented by arrow 20 exits laterally at port 22 and creates a reduced pressure at inlet 24 to draw the screened fluid through the screen 18.

Attached to the inlet 12 is a tubular extension 26 that continues the inlet 12. At its lower end 28 the hose 30 is attached. Hose 30 extends through support 32 and hose guide 34. Hose guide 34 is a bend of a desired angle and shown as a 90 degree bend in FIG. 1. The anchoring system 36 is illustrated schematically. It can constitute drag blocks and a j-slot or drag blocks and movement of device 10 or they can be flow actuated using the circulation through the tool 10 represented by arrow 38. Support 32 is hung from sleeve 40 with extension 26 running through opening 42 and having a travel stop 44 within sleeve 40 attached to it. When the anchor assembly 36 is not set rotation of extension 26 rotates the guide 34 since rotation of extension 26 through a hex shape of tube 46 and opening 42 results in sleeve 40 turning, which turns support 42. Alternatively the guide 34 can be pivotally mounted to the support 32 so that even when the anchor assembly 36 is set the guide can be rotated about a longitudinal axis as schematically represented by 48. Also schematically represented is a telescoping body on the support 32 shown as 50. This allows axial movement of the guide 34 with the anchor assembly 36 in the set position. The telescoping movement can be enabled or disabled with a j-slot assembly or other type of selective locking device.

Figure 2:
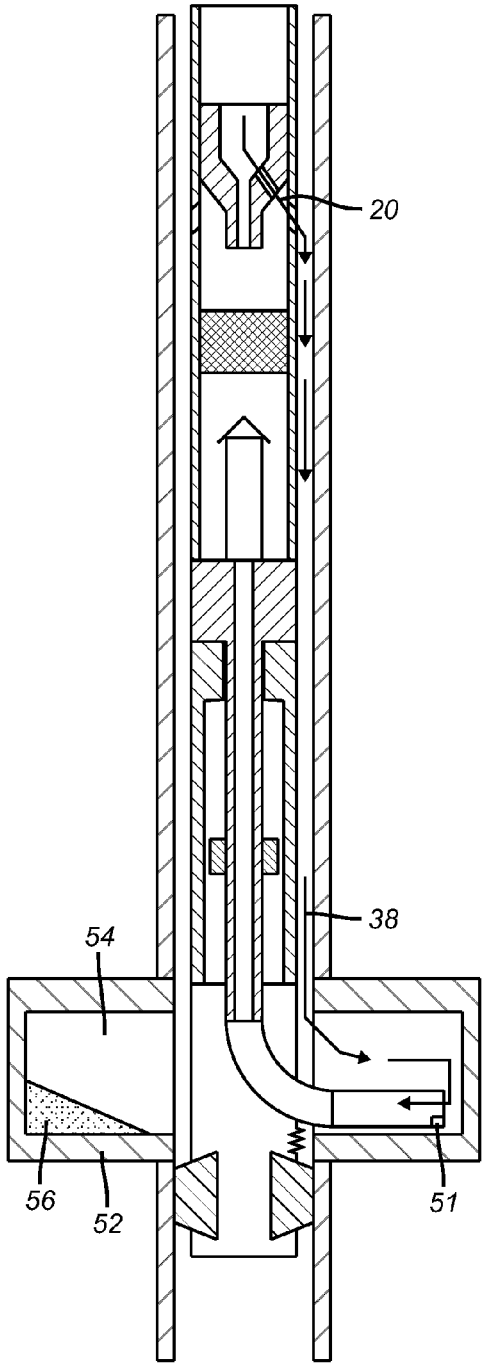
FIG. 2 is the view of FIG. 1 in the set position for removing debris from a recess.

In use in FIG. 2 the tool 10 can be manipulated to get the anchor assembly 36 set against a surrounding tubular or some other setting technique can be employed as previously described. Weight can be set down on the tool 10 to extend the hose 30 through the guide 34. If the hose needs to be raised or lowered the anchor assembly 36 can be released or the telescoping feature 50 can be deployed with the anchor assembly still engaging the surrounding tubular as another option. To rotate the guide 34 a swivel 48 can be used with the anchor assembly 36 set or the anchor assembly 36 can be unset and rotation of the tool 10 can reorient the hose in a single plane.

A combination camera and light shown schematically as 51 can be deployed in the hose 30 or adjacent to it on the outside. It can be powered and send images to the surface through a line or lines from the surface and a swivel connection or slack can be employed to avoid getting the lines in a bind. The line can be fiber optic for video and for lighting the subject area. The camera 51 will telescope with the hose 30 and a conduit or conduits for flushing fluid can be routed to the lens area to keep it clear of debris.

The assembly can be used to clean a recess 54 in a BOP stack 52 where debris 56 can accumulate with the rams in the open position. The entire assembly can be released with a release of the anchor assembly 36 and an entire BOP stack can be cleaned to assure future functionality. Other recesses in a tubular string can also be cleaned using the assembly and drawing in the debris 56 in to the directed end of the hose 30.

Other variations are contemplated such as the guide 34 being at angles different than 90 degrees or being a multi-component articulated assembly that can be controlled from the surface so that the guiding angle can be changed with the assembly in the subterranean location to better direct the end of the hose 30 so there are more degrees of freedom of movement to pinpoint the end at the debris and even physically move the debris around to dislodge it. Alternatively the hose 30 can instead or as well be extended and retracted to accomplish the dislodging mission.

Those skilled in the art will appreciate that instead of stirring up all the debris as with a jet system and hoping to capture it the use of a vacuum system to pick up debris allows the debris to be removed with minimal agitation so that the chance for getting more of it is heightened. Being able to see the process with a light and camera adds to its effectiveness and allows inspection to determine that the task is effectively completed. There are also multiple degrees of freedom of movement of the end of the hose with the anchor set. It can be extended and retracted in a given plane or rotated in that plane. The hose end can be skewed above or below a given plane with an articulated guide or its orientation can be kept in on plane as it is raised or lowered to an adjacent parallel plane. Combinations of such movements can be employed to reach hard to get to locations or to use the hose end as a pry to dislodge debris so that it can be collected by the hose.

The above description is illustrative of the preferred embodiment and various alternatives and is not intended to embody the broadest scope of the invention, which is determined from the claims appended below, and properly given their full scope literally and equivalently.

We claim:

1. A debris removal apparatus for subterranean use, comprising:

a fluid operated housing;

a screen in said housing for retaining debris, said debris drawn in from an inlet to enter and continue into the housing in an axial path to maintain fluid velocity, said inlet is articulated to selectively move into a recess in a tubular string assembly.

2. The apparatus of claim 1, wherein:

said inlet is located at a lower end of said housing.

3. The apparatus of claim 2, wherein:

said inlet comprises a flexible conduit.

4. The apparatus of claim 3, wherein:

said flexible conduit extends through a support, said support selectively secured with an anchor assembly thereon.

5. The apparatus of claim 4, wherein:

said support comprises a guide to reorient an end of said flexible conduit away from a longitudinal axis of said housing.

6. The apparatus of claim 5, wherein:

said guide reorients said end of said flexible conduit in a fixed or variable angle with respect to said longitudinal axis of said housing.

7. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said guide reorients said end of said flexible conduit in a fixed or variable angle with respect to said longitudinal axis of said housing;

said guide is selectively articulated.

8. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said guide reorients said end of said flexible conduit in a fixed or variable angle with respect to said longitudinal axis of said housing;

said guide reorients said end of said flexible conduit by 90 degrees.

9. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said guide is movable along the longitudinal axis of said housing with said anchor set so that said guide can be raised or lowered.

10. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said guide can swivel with said anchor set to reorient said end of said flexible conduit in a given plane.

11. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said inlet comprises a rigid conduit supporting said flexible conduit on an end of said rigid conduit;

said rigid conduit is movably secured to said support.

12. The apparatus of claim 11, wherein:

said rigid conduit is rotationally locked to said support.

13. The apparatus of claim 11, wherein:

said rigid conduit is axially movable with respect to said support when said anchor is set for selective extension and retraction of said flexible conduit with respect to said guide.

14. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said flexible conduit further comprises a camera and light to allow surface observation of debris as debris is removed.

15. The apparatus of claim 14, wherein:

said camera and said light are mounted within said flexible conduit.

16. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

the recess is defined by a blowout preventer.

17. A debris removal apparatus for subterranean use, comprising:

a fluid operated housing for taking in and retaining debris having an inlet for debris laden fluid to enter that is articulated to selectively move into a recess in a tubular string assembly;

said inlet is located at a lower end of said housing;

said inlet comprises a flexible conduit;

said flexible conduit extends through a support, said support selectively secured with an anchor assembly thereon;

said support comprises a guide to reorient an end of said flexible conduit away from a longitudinal axis of said housing;

said guide reorients said end of said flexible conduit in a fixed or variable angle with respect to said longitudinal axis of said housing;

said guide is movable along the longitudinal axis of said housing with said anchor set so that said guide can be raised or lowered.

18. The apparatus of claim 17, wherein:

said guide can swivel with said anchor set to reorient said end of said flexible conduit in a given plane.

19. The apparatus of claim 18, wherein:

said inlet comprises a rigid conduit supporting said flexible conduit on an end of said rigid conduit;

said rigid conduit is movably secured to said support.

20. The apparatus of claim 19, wherein:

said rigid conduit is movably secured to said support; and said rigid conduit is rotationally locked to said support.

21. The apparatus of claim 20, wherein:

said flexible conduit further comprises a camera and light to allow surface observation of debris as debris is removed.

22. The apparatus of claim 21, wherein:

the recess is defined by a blowout preventer.

* * * * *